United States Patent [19]

Renoux

[11] 4,380,950

[45] Apr. 26, 1983

[54] LOADING APPARATUS FOR A MEDIUM CALIBER WEAPON

[75] Inventor: Lucien H. Renoux, Le Havre-Graville, France

[73] Assignee: Hispano-Suiza, Saint-Cloud, France

[21] Appl. No.: 157,304

[22] Filed: Jun. 9, 1980

[30] Foreign Application Priority Data

Jun. 15, 1979 [FR] France ..... 79 15878

[51] Int. Cl.[3] ..... F41F 9/06

[52] U.S. Cl. ..... 89/33 BA; 89/45

[58] Field of Search ..... 89/33 BA, 33 BC, 33 CA, 89/33 D, 34, 44, 45, 37 G, 1 F, 1 J

[56] References Cited

U.S. PATENT DOCUMENTS

| | | | |
|---|---|---|---|
| 341,371 | 5/1886 | Bruce | 89/33 BA |
| 2,122,423 | 7/1938 | Joyce | 89/33 BA |
| 3,134,301 | 5/1964 | Even | 89/33 |
| 3,598,016 | 8/1971 | Chiabrandy et al. | 89/43 A |
| 3,999,460 | 12/1976 | Skliris | 89/1.803 |

FOREIGN PATENT DOCUMENTS

| | | | |
|---|---|---|---|
| 700621 | 12/1964 | Canada | 89/33 BA |
| 21921 | 7/1981 | European Pat. Off | 89/33 BA |
| 1140494 | 11/1962 | Fed. Rep. of Germany | 89/45 |
| 1231594 | 12/1966 | Fed. Rep. of Germany | 89/33 BA |
| 2457558 | 12/1973 | Fed. Rep. of Germany | 89/45 |
| 2501425 | 7/1975 | Fed. Rep. of Germany | 89/45 |
| 2433568 | 1/1976 | Fed. Rep. of Germany | 89/45 |
| 881054 | 11/1961 | United Kingdom | 89/45 |

*Primary Examiner*—Sal Cangialosi

*Attorney, Agent, or Firm*—Larson and Taylor

[57] ABSTRACT

This loading device for an average-caliber weapon mounted in a turret comprises a barrel-shaped body rotatably mounted in a fixed casing. In the barrel-shaped body are provided several positions spread out around the axis of rotation and each intended to receive a piece of ammunition. Means are provided for rotating the barrel-shaped body through angular steps equal to the gap between successive positions so as to cause each of the positions to coincide in turn with a removal aperture provided in the casing.

7 Claims, 3 Drawing Figures

LOADING APPARATUS FOR A MEDIUM CALIBER WEAPON

BACKGROUND AND SUMMARY OF THE INVENTION

The present invention relates to loading of medium caliber fire weapons and is particularly—but not exclusively—suitable for loading mortars and guns carried by turrets and vehicles.

The words "medium caliber weapon" are to be construed as designating those weapons which fill the gap between the small-caliber automatic weapons fed by racks, bands or clips and the weapons whose ammunition has a weight which excludes manual handling. It may be considered that the weight of a round of ammunition of a medium caliber weapon is of from a few Kg to about twenty Kg.

The turret mounted medium caliber weapons are typically loaded manually. The rounds of ammunition are stored inside the turret in racks of appropriate size or around the "basket" supported by the turret and accommodating the crew. The rounds of ammunition are stored at locations at different distances from the weapon. The gunner must carry them over a length which varies with the storage location of the round. While the constraint is often acceptable, it represents a serious disadvantage during actions which require fast firing: in fact, it is difficult to fire several successive rounds at a rate of ten shots per minute.

Another prior art apparatus (U.S. Pat. No. 3,134,301) comprises a barrel body mounted for rotation about a substantially horizontal axis in a casing. Several locations regularly distributed about the axis are formed in the barrel each for receiving one round of ammunition. Means are provided for rotating the barrel angularly by steps equal to the angular interval between successive locations. Consequently each location in succession may be moved to register with an aperture in the casing for loading the round by axial forward movement thereof. The barrel is located immediately behind the breech of the weapon but transversely offset to provide the room necessary due to recoil movement of the weapon; a transversely movable cradle must be provided for carrying the round of ammunition from the barrel to a position in alignment with the weapon. The cradle and its drive and guide system increase the bulk and the intricacy of the apparatus and slow down the firing rate and the apparatus is designed for the weapon to be loaded through the barrel only.

It is an object of the invention to provide an improved loading apparatus for medium caliber weapons; it is another object of the invention to provide an apparatus which makes it possible for the gunner manning the weapon to have at his disposal several rounds of ammunition in a preparatory intermediate position in the vicinity of the cartridge chamber of the weapon, without any interference with conventional manual loading and with the aiming system. It is a more particular object to improve the ergonomic conditions of firing and to increase the firing rate temporarily with a system which is simple, rugged and reliable.

The apparatus according to the invention has a stationary casing located behind the cartridge chamber of the weapon and having an ammunition outlet aperture. A barrel is mounted in said casing for rotation about a substantially horizontal axis and is formed with a plurality of ammunition receiving locations distributed at equal angular intervals about said axis. The barrel may be rotated by manually actuable means by angular steps selected to bring each location in turn into registry with the aperture. The round of ammunition in the registering location may be withdrawn through the aperture. The casing need not and will not be carried by the weapon, but may rather be fixed to the structure supporting the weapon, typically a turret. The casing will be located and arranged with respect to the cartridge chamber to leave free a path for inserting a round of ammunition into said cartridge chamber directly.

Latch means will preferably be provided for non-rotatably connecting said barrel and casing and typically operatively associated with the manually actuatable means for being rendered cooperative upon actuation of said manually actuatable means. Resiliently returned aperture closing means may be used for preventing movement of the ammunition out of the casing when in registry with said aperture in the casing. The closing means may consist of a spring biased pin which is moved away by the gunner for loading.

When the apparatus is carried by a turret, for instance on an armoured vehicle, the casing is typically fixed to the turret wall, rearwardly of the cartridge chamber of the weapon and slightly offset whereby it allows recoil and does not hinder introduction of a round of ammunition directly taken from a storage location in the turret. Ammunition guide means may be located between the aperture of the casing and the cartridge chamber. They may consist of a rotary roller mounted in a position such that the rear of the ammunition is carried by the roller when the cap comes into contact with the breech. Thus the casing may be placed at a distance from the breech of the weapon which is slightly greater than the length of the ammunition without the gunner having to support the whole weight of the ammunition during transfer.

The invention will be better understood from reading the description which follows of a particular embodiment given by way of example only.

SHORT DESCRIPTION OF THE DRAWINGS

DETAILED DESCRIPTION OF A PARTICULAR EMBODIMENT

Figure 1:
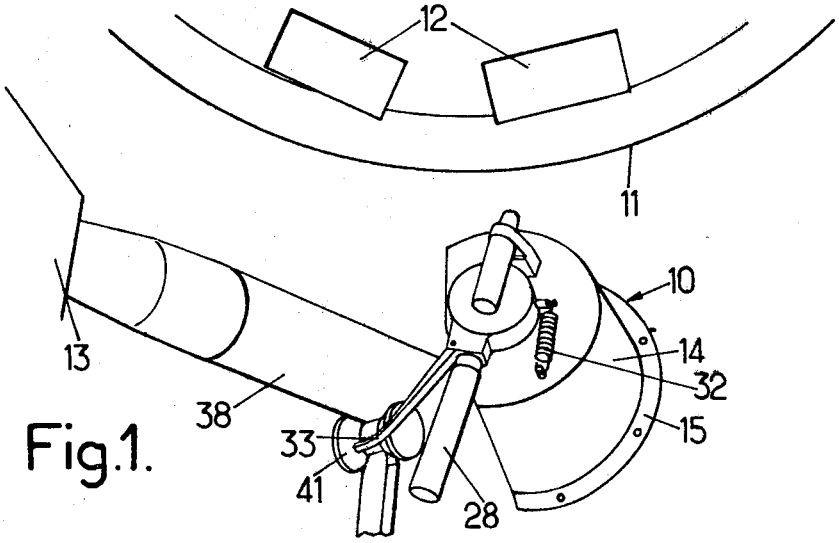
FIG. 1 is a schematical isometric view showing an apparatus according to the invention in a turret.

Referring to FIG. 1, there is shown a loading apparatus 10 designed for being carried by a turret, of which only the junction line 11 with an upper hatch is shown. A plurality of sighting scopes 12 are carried by the turret. The tube of a medium-caliber weapon whose breech block appears partially at 13, projects through the front armor plating of the turret.

Figure 3:
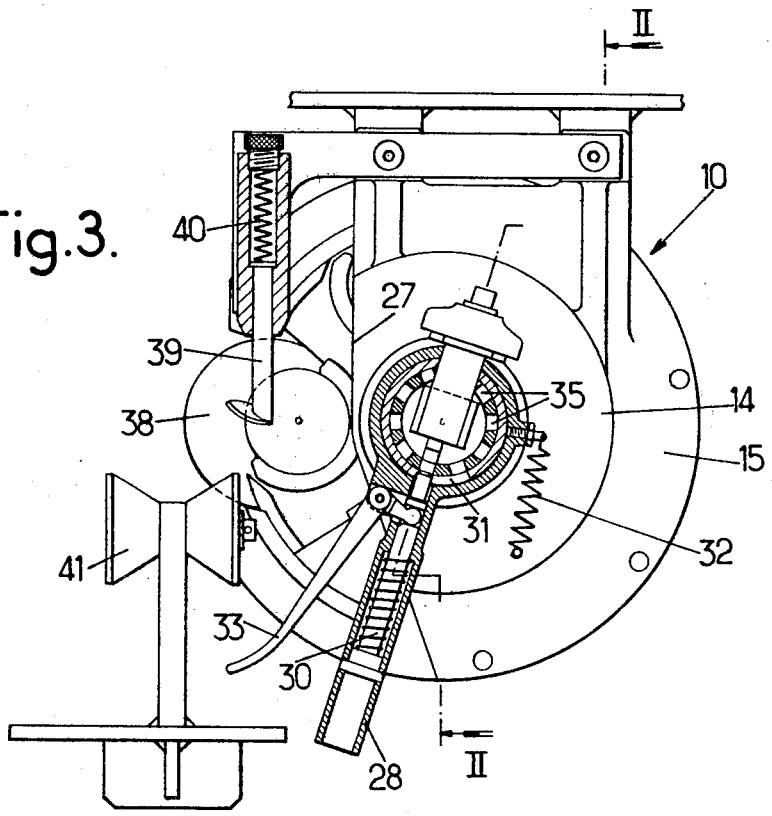
FIG. 3 is a view of the apparatus from the lefthand side of FIG. 2.
Figure 2:
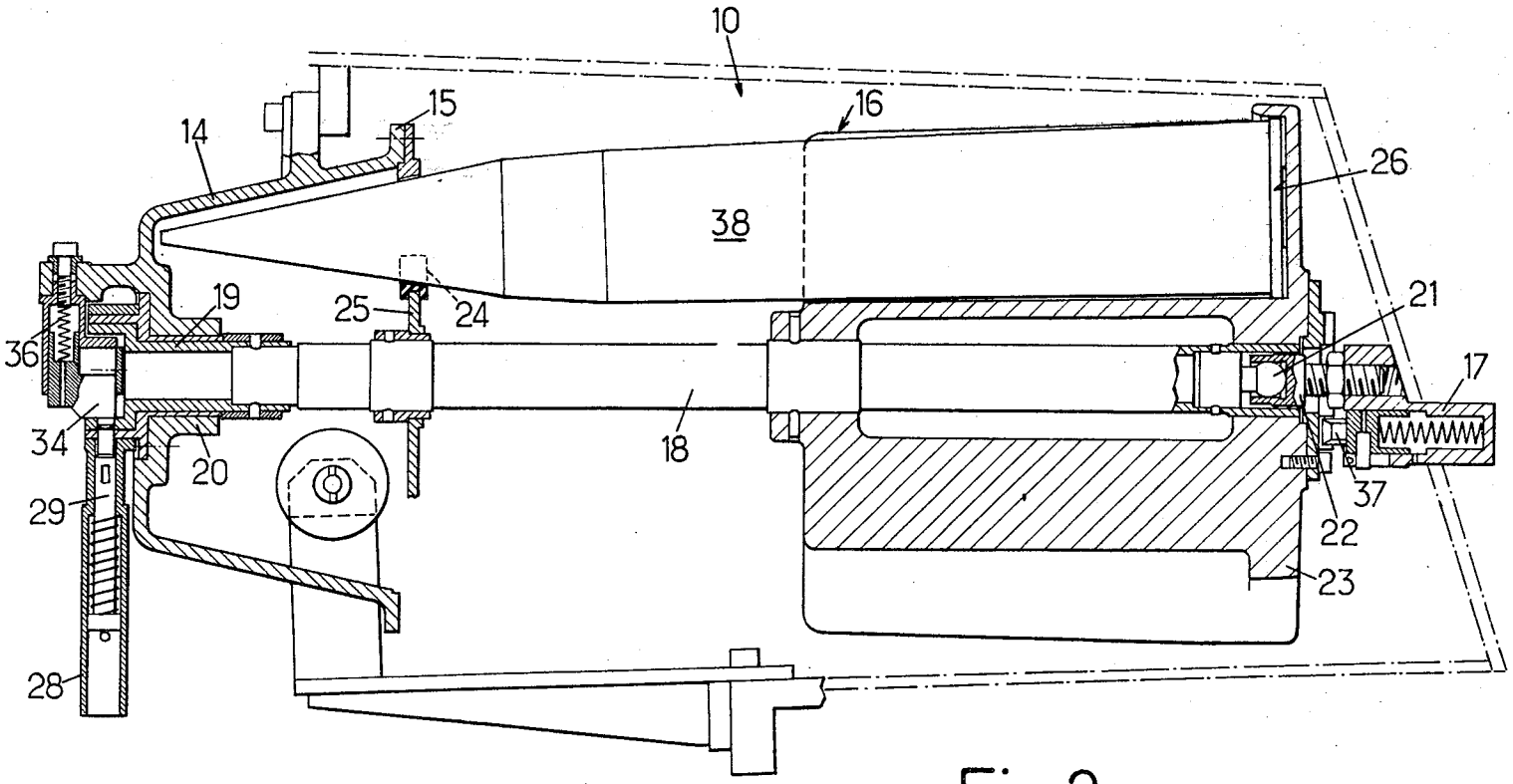
FIG. 2 is a sectional view of the apparatus along line II—II of FIG. 3.

Apparatus 10 is secured to a wall provided at the rear of the turret; it may have the construction shown in a simplified form in FIGS. 2 and 3. It comprises a barrel assembly having a fixed casing 14 with flange 15 secured to the wall by appropriate means (not shown) and a barrel-shaped body 16 made from several assembled parts. Casing 14 envelopes the front part of the barrel-shaped body, except in a zone where it is provided with an aperture 27 for passing the ammunition there-through, one round at a time; at the rear, it constitutes a housing 17 whose function will appear later on.

Barrel 16 has a central shaft 18 whose front end portion is secured to a sleeve 19 rotatably received in a bearing 20 carried by the casing. The rear end of shaft 18 is provided with a ball 21 imprisoned in a socket of a gudgeon 22 fixed in an adjustable position to housing 17. On the rear part of shaft 18 is keyed a drum or magazine 23 in which are provided recesses each adapted to receive a round of ammunition. In the embodiment illustrated, the drum 23 is formed with five recesses. Each round of ammunition comprises a shell and a case. When stored, the case is retained against the end wall of the corresponding recess and the cap of the shell is supported by a fork 24 provided on a support disk 25 secured to the front part of shaft 18.

Referring to FIG. 2, it will be readily appreciated that each round of ammunition, except when it is opposite aperture 27, is rigidly held in barrel 16. Its front end is retained between a fork 24 of the barrel and casing 14 (FIG. 2) the shapes of which are such that they prevent the round of ammunition from escaping radially and they hold the ammunition engaged into a flanged end wall 26 positively determining the position of the round.

The barrel shown in FIGS. 2 and 3 is intended to store five rounds of ammunition. But that number is not limitative. The apparatus of the invention is of advantage when provided for at least two shots. The number of ammunition rounds stored will depend on the missions contemplated and on the space available for housing the apparatus. Furthermore, drum 23 may have a shape other than illustrated. For instance, the flanges 26 may define circular recesses, or they may be replaced by radial arms or by any other arrangement ensuring correct retention.

The manually actuatable means for rotating the barrel-shaped body 16 are formed, in the illustrated embodiment, by a handle 28 in which a pawl 29 is slidably received. A return spring 30 biases the pawl to a retracted position. In this position, the pawl 29 projects outside handle 28 by an amount which is such that it is still engaged into an elongated opening or slot 31 provided in a sleeve secured to bearing 20. A return spring 32 exerts on handle 28 a force which tends to move it angularly into an abutment position in which pawl 29 bears against one end of slot 31. The latter has an angular size corresponding to half of the angular distance between two successive positions in the barrel.

Handle 28 carries a lever 33 for moving pawl 29, against the return force of spring 30, so as to engage it in one of the holes 35 provided for that purpose in sleeve 19, as shown in FIG. 3. Such an actuation has two effects: it interlocks rotation handle 28 with the barrel-shaped body for rotation as a whole; it forces a latch 34 out of a corresponding hole 35 in sleeve 19, against the action of a return spring 36. In the embodiment illustrated in FIGS. 2 and 3, the barrel has five shell receiving positions, whereas there are ten holes 35. Two successive angular reciprocations of the handle are required for passing from one position to the next. This arrangement, which results into a smaller angular extent of movement of the handle, is obviously not indispensable.

As a measure of security, the apparatus shown in FIG. 2 comprises an additional resiliently returned bolt 37 which avoids unwanted rotation of the barrel-shaped body. This additional bolt, carried by box 17, may be omitted.

It will be appreciated that each round of ammunition placed in a storage position is positively held by the casing and by the barrel. On the other hand, additional means must be provided for preventing the round of ammunition 38 placed opposite the outlet opening, i.e. in stand-by condition, from escaping. In the embodiment shown in FIG. 3, a retaining member is provided formed by a pin 39 slidably mounted in a boss of the casing. A spring 40 biases pin 39 into a position where it bears on the cap of shell 38 and prevents it from escaping.

The operation of the device which has just been described is clear form the description and will then be only briefly mentioned.

The personnel manning the weapon must first of all locate five rounds of ammunition in the apparatus, in addition to the ammunition stored at fixed positions in the turret. With this operation finished, the gunner has at his disposal one round of ammunition directly available and four rounds stored in the barrel. If he is to fire at a limited rate, he will use the ammunition stored in the fixed positions. If, on the other hand, he is to fire at a rapid rate, he may use successively the five rounds of ammunition stored in the device. He will first of all be able to remove the first round of ammunition simply by pushing pin 39 back with his thumb, then by sliding the shell until it bears against the breech block of the weapon. For getting another round of ammunition in the same position as the first one, the gunner has to grip the handle, operate the lever, move the handle angularly until it stops, release it, and carry out a second identical movement.

As indicated above, the apparatus should not hinder loading of the weapon when using ammunition from another storage location. For that, the apparatus will be placed at a distance from the breech greater than the length of the ammunition, preferably slightly greater only. So as to avoid the gunner from having to support the whole of the weight of the ammunition during transfer, guide means will advantageously be provided. In the embodiment illustrated, the guide means are formed by a roller 41 of diabolo shape, mounted on a frame secured to casing 14. The diabolo is at a distance from the breech such that the cap of the shell is supported by the breech block whereas the case is still supported by the diabolo. It can be seen that the invention allows the gunner to have permanently available a reserve of a few rounds of ammunition which he can fire at an extremely rapid rate, while being able to keep this reserve for urgent cases owing to the possibility of manual loading which he uses for the rest of the time. It will also be appreciated that the apparatus is so located that it leaves the space in the front part of the crew compartment, on each side of the weapon, wholly unobstructed. Consequently the space is available for conventional night and/or day sighting and aiming devices. Last the apparatus may be used to retrofit exiting turrets.

I claim:

1. In a turret assembly comprising a turret and a manually loaded medium caliber weapon supported by the turret and having a cartridge chamber into which each round of ammunition is manually inserted by forward movement of the round into the chamber, a loading apparatus comprising:

a stationary casing fixed to said turret behind said cartridge chamber and having an ammunition outlet aperture located rearwardly of said cartridge chamber at a distance thereof slightly in excess of the length of an individual said round, and offset to the side of the centerline of the chamber to provide a spacing rearwardly of the cartridge which is unobstructed to permit manual transport of a round of ammunition from the outlet aperture of the casing and also manual loading of a round of ammunition from a location other than the loading apparatus, a barrel mounted in said casing for rotation about a substantially horizontal axis offset laterally relative to the cartridge chamber centerline, formed with a plurality of ammunition receiving locations distributed at equal angular intervals about said axis, said casing and barrel having cooperating means for individually retaining each said round at a receiving location when not in a registry with said ammunition outlet aperture, manually actuatable means for rotating said barrel by angular steps selected to bring each location in turn into registry with said aperture, whereby the round of ammunition in the registering location may be manually withdrawn forwardly through said aperture and slightly laterally into the cartridge chamber.

2. A turret assembly according to claim 1, further comprising latch means, resilient means for forcing said latch means into a position preventing movement of the ammunition out of the casing when in registry with said aperture in the casing, said latch means being constructed and arranged for manual movement out of the path of the ammunition against the return force of said resilient means.

3. An turret assembly according to claim 1, further comprising latch means for preventing said barrel from rotating, said latch means being operatively associated with said manually actuatable means for being rendered unoperative upon actuation of said manually actuatable means.

4. An turret assembly according to claim 1, wherein said manually actuatable means comprise a handle mounted on the casing for rotation between a rest position and a fully displaced position, resilient return means urging said handle towards said rest position and pawl and ratchet means operatively connecting said handle and barrel.

5. Turret assembly according to claim 4, wherein said pawl is carried by said handle and operatively associated with a latch retaining the barrel against rotation for rendering said latch unoperative upon actuation of the pawl.

6. Turret assembly according to claim 1, further comprising guide means located at a predetermined position between said aperture and the cartridge chamber of the weapon selected for said guide means to support said ammunition at least until the latter is supported by the cartridge chamber upon forward movement of the ammunition.

7. Apparatus according to claim 6, wherein said casing is secured to the wall of a turret carrying the weapon at a distance slightly in excess of the length of the ammunition.

* * * * *